US006471557B1

(12) United States Patent
Hattori

(10) Patent No.: US 6,471,557 B1
(45) Date of Patent: Oct. 29, 2002

(54) ENGINE COMPARTMENT FOR PERSONAL WATERCRAFT

(75) Inventor: Toshiyuki Hattori, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/280,262

(22) Filed: Mar. 29, 1999

(30) Foreign Application Priority Data

Mar. 27, 1998 (JP) ..... 10-100426

(51) Int. Cl.[7] ..... B63H 21/10; B63B 35/73
(52) U.S. Cl. ..... 440/88; 114/55.53
(58) Field of Search ..... 114/55.5, 55.51, 114/55.53, 55.57; 440/88, 89

(56) References Cited

U.S. PATENT DOCUMENTS

| | | | | |
|---|---|---|---|---|
| 4,982,682 A | | 1/1991 | Hattori | |
| 4,991,532 A | * | 2/1991 | Locke | 114/211 |
| 5,136,547 A | * | 8/1992 | Laukien | 367/1 |
| 5,330,374 A | * | 7/1994 | Ishino | 440/42 |
| 5,389,022 A | * | 2/1995 | Kobayashi | 440/89 |
| 5,390,621 A | | 2/1995 | Hattori et al. | |
| RE34,922 E | | 5/1995 | Hattori et al. | |
| 5,417,195 A | * | 5/1995 | Tachikaawa et al. | 123/585 |
| 5,586,922 A | * | 12/1996 | Kobayashi et al. | 440/88 |
| 5,619,950 A | * | 4/1997 | Ikeda | 114/363 |
| 5,636,586 A | | 6/1997 | Suganuma | |
| 5,647,779 A | | 7/1997 | Nanami | |
| 5,664,515 A | | 9/1997 | Hattori et al. | |
| 5,699,749 A | * | 12/1997 | Yamada et al. | 114/55.51 |
| 5,723,828 A | * | 3/1998 | Nakagawa | 181/250 |
| 5,735,229 A | * | 4/1998 | House et al. | 114/363 |
| 5,743,206 A | * | 4/1998 | Hattori | 114/55.51 |
| 5,846,102 A | * | 12/1998 | Nitta et al. | 440/1 |
| 5,957,072 A | * | 9/1999 | Hattori | 114/55.57 |
| 5,979,598 A | * | 11/1999 | Wolf et al. | 181/272 |
| 6,019,648 A | * | 2/2000 | Lecours et al. | 440/38 |
| 6,139,381 A | * | 10/2000 | Suzuki et al. | 440/88 |

FOREIGN PATENT DOCUMENTS

| | | |
|---|---|---|
| JP | 8-104286 | 4/1996 |
| JP | 8-104295 | 4/1996 |

OTHER PUBLICATIONS

Design of a "Helmoltz" Resonating Case for Use with Piezo Benders, www.projectsunlimited.cin/AudioProducts/Glossary.asp?ID=2, May 29, 2001, 4 pages.
Q&A Session 6, www.phys.unt.edu/ matteson/1251–001/Q&A6.html, May 26, 2001, 2 pages
ME458 Noise Control Laboratory #9, ME458 Lab 9, Aug. 17, 2000, 2 pages.
Van Nostrand's Scientific Encyclopedia Eighth Edition, Douglas M. Considine, P.E. and Glenn D. Considine, Van Nostrand Reinhold, 1995, 3 pages.
SAE International (SAE J1973), Personal Watercraft Floatation—Surface Vehicle Recommended Practice, Apr. 4, 1991.
33 CFR § 186.630 Standards for Natural Ventilation.

* cited by examiner

*Primary Examiner*—S. Joseph Morano
*Assistant Examiner*—Andrew Wright
(74) *Attorney, Agent, or Firm*—Knobbe, Martens, Olson & Bear, LLP.

(57) ABSTRACT

A watercraft includes a hull construction that incorporates several aspects to reduce the operating noise of the watercraft. One structural aspect improves sound insulation about the engine compartment, and includes a seat design that facilitates such improvement. Insulating material is injected between the hull and inner walls and inserts. The seat design also incorporates air pockets to insulate an upper side of an engine compartment and aft compartment in which a water trap is located. The air supply and cooling system of the watercraft also uses resonator chambers to quiet engine and exhaust noise emitted through the ducts of the system. Another aspect involves insulating a portion of the exhaust system within the insulating material. These aspects of the hull construction each reduce the operating noise of the watercraft.

25 Claims, 5 Drawing Sheets

ENGINE COMPARTMENT FOR PERSONAL WATERCRAFT

BACKGROUND OF THE INVENTION

1. Field of the Invention

The present invention relates to a small watercraft, and more particularly to the layout of engine components within the watercraft and an associated seat design.

2. Description of Related Art

Personal watercraft have become very popular in recent years. This type of watercraft is quite sporting in nature and carries a rider and possibly one, two or three passengers. A relatively small hull of the personal watercraft commonly defines a riders' area above an engine compartment. An internal combustion engine frequently powers a jet propulsion unit which propels the watercraft. The engine lies within the engine compartment in front of a tunnel formed on the underside of the watercraft hull. The jet propulsion unit is located within the tunnel and is driven by a drive shaft. The drive shaft usually extends between the engine and the jet propulsion device, through a wall of the hull tunnel.

Despite their popularity, many areas have begun imposing restrictions on personal watercraft due in part to the high decibel operating noise of such crafts. Prior personal watercraft have attempted to lessen exhaust and engine noise by a variety of ways. Some personal watercraft exhaust into the tunnel, as taught by, e.g., U.S. Pat. No. 4,811,560, as well as include one or more expansion chambers (e.g., U.S. Pat. No. 5,234,364) in the exhaust system in order to reduce exhaust noise. Some prior watercraft have also lined the engine compartment with a sound insolating material. While such approaches have lessened the exhaust and operating noise associated with the personal watercraft, a need exists for additional noise reduction.

SUMMARY OF THE INVENTION

The present watercraft involves several approaches to reduce the operating noise of the watercraft. One approach involves improved sound insulation about the engine compartment, and includes a seat design that facilitates such improvement. Another approach involves silencing the sound that is emitted from the engine compartment through the air ducts of the watercraft. And a further approach involves insulating a portion of the exhaust system. These approaches, as well as others described below, can be used together or alone within a watercraft in order to lessen operating noises of the watercraft.

One aspect of the present invention thus involves a watercraft comprising a hull having a lower hull portion and an upper deck portion. An internal combustion engine is located within the hull and has an output shaft. A propulsion device is carried by the hull and is driven by the engine output shaft to propel the watercraft. The deck portion includes a central elongated pedestal having first and second sections. The firs section is removable attached to the second section and is arranged to form at least a portion of an upper surface of the pedestal. The deck portion also includes a seat with a base. The seat base is removably attached to the pedestal. In a preferred mode, one or more air pockets are defined between the cover and the seat base to provide sound insulation.

The engine compartment also can further silenced by insulation layers about the side walls of a seat pedestal in which at least a portion of the engine is located. In some modes, at least a portion of the exhaust system can also be insulated within such insulation layers.

Another aspect of the present invention involves a watercraft comprising a hull having a lower hull portion and an upper deck portion. An internal combustion engine is located within the hull and has an output shaft. A propulsion device is carried by the hull and is driven by the engine output shaft to propel the watercraft. The hull also includes at least one air duct with first and second ports. The first port is arranged to communicate ambient air from outside the hull, and the second port opens into the hull. A sub-resonator chamber communicates with the air duct at a portion between the first and second ports. The sub-resonator chamber preferably is tuned (i.e., sized and shaped) to reduce noise emitted through the air duct.

In accordance with a further aspect of the present invention, a watercraft is provided comprising a hull having a lower hull portion and an upper deck portion. An engine compartment is formed within the hull and is defined between a fore bulkhead and an aft bulkhead. Each bulkhead includes at least one tube that communicates with the engine compartment. An internal combustion engine is located within the engine compartment and has an output shaft. A propulsion device is carried by the hull and is driven by the engine output shaft to propel the watercraft. With this construction, the bulkheads help silence engine and exhaust noise.

An additional aspect of the present invention involves a watercraft comprising a hull having a lower hull portion and an upper deck portion. An engine compartment is formed within the hull and is defined between a fore bulkhead and an aft bulkhead. A fore air duct opens into the hull forward of the fore bulkhead and an aft air duct opens into the hull rearward of the aft bulkhead. An internal combustion engine is located within the engine compartment and has an output shaft that drives a propulsion device to propel the watercraft. The arrangement of the air ducts relative to the engine and bulkheads further assists in noise reduction.

Further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment of the watercraft is intended to illustrate, but not to limit the invention. The drawings contain the following figures.

DETAILED DESCRIPTION OF THE PREFERRED EMBODIMENT

FIGS. 1 through 5 illustrate a personal watercraft 10 that includes a seat design and associated engine compartment layout configured in accordance with a preferred embodiment of the present invention. Although these features are illustrated in connection with a personal watercraft, they can be used with other types of watercraft as well, such as, for example, but without limitation, small jet boats and the like.

The following describes the illustrated watercraft in reference to a coordinate system in order to ease the description of the watercraft. A longitudinal axis extends from bow to stem and a lateral axis extends from port side to starboard side normal to the longitudinal axis. In addition, relative heights are expressed in reference to the undersurface of the watercraft. And in FIG. 1, a label "forward" has been included for reference purposes.

Figure 1:
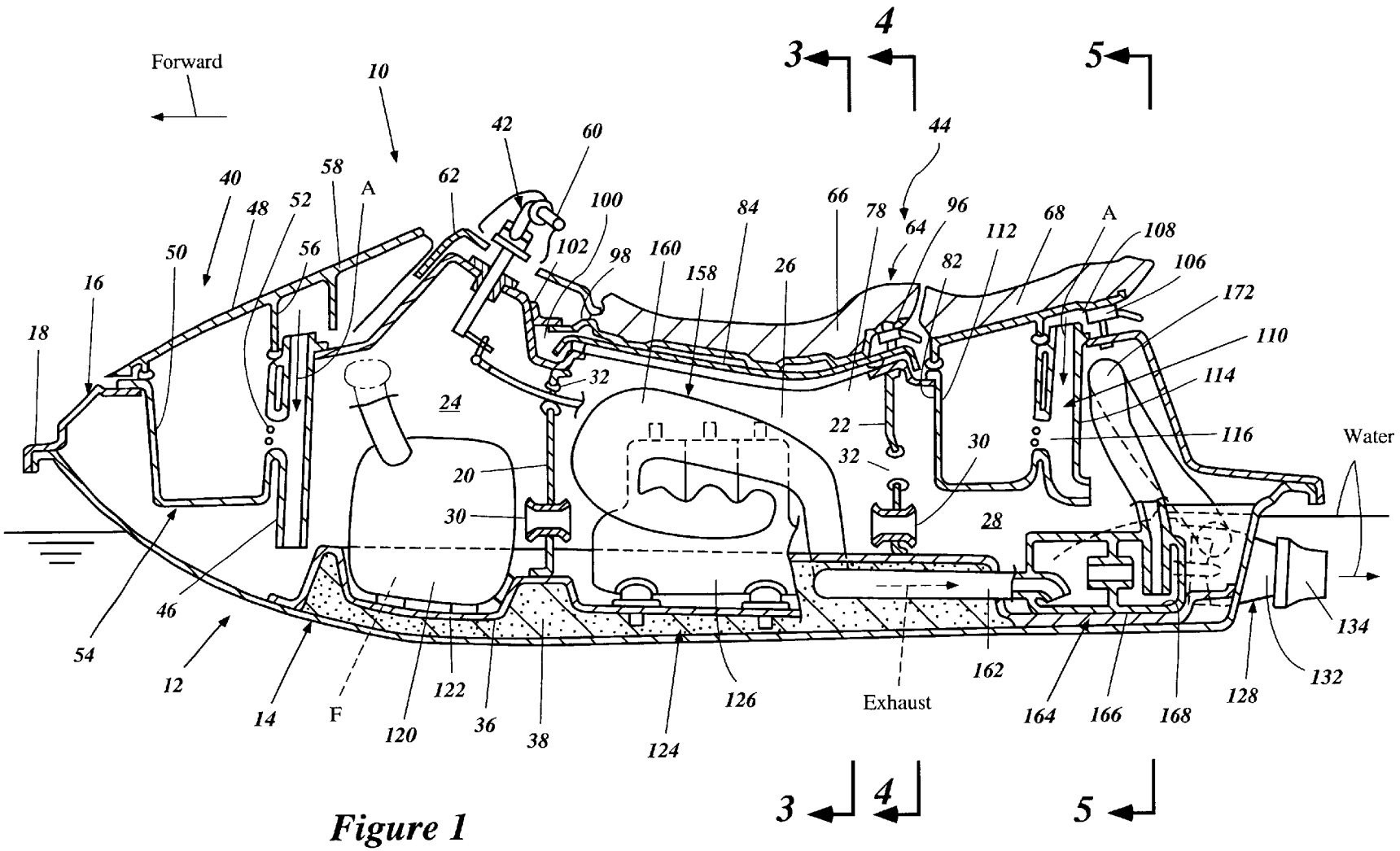
FIG. 1 is a cross-sectional, side elevational view of a personal watercraft configured in accordance with a preferred embodiment of the present invention.
Figure 2:
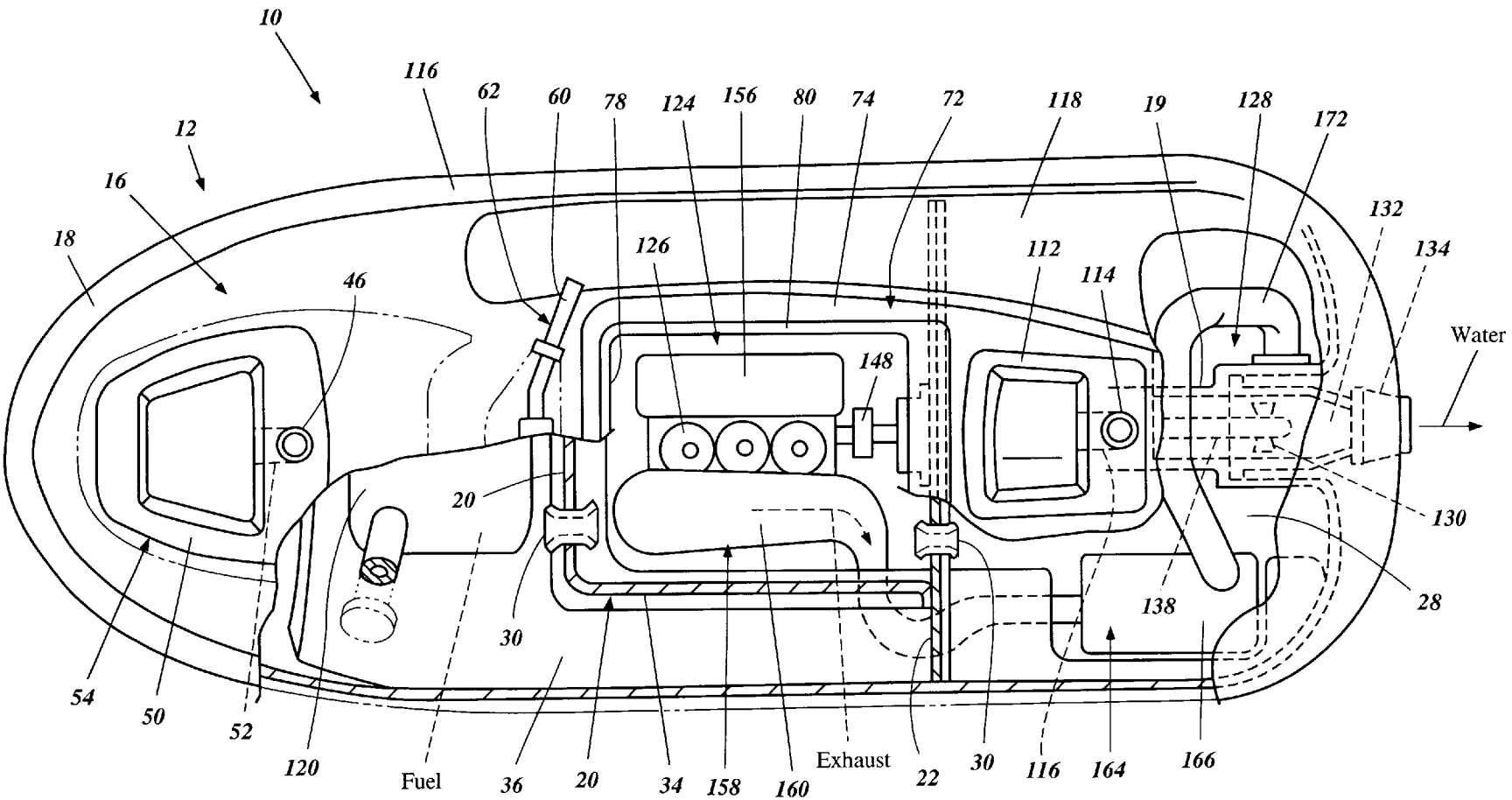
FIG. 2 is a partial sectional, top plan view of the personal watercraft of FIG. 1.

With initial reference to FIGS. 1 and 2, the watercraft 10 includes a body 12 formed by a hull 14 and a deck 16. The hull 14 and the deck 16 are formed from a suitable material such as, for example, a molded fiberglass reinforced resin or SMC. The hull 14 and the deck 16 are fixed to each other around the peripheral edges 18 in any suitable manner.

In the illustrated embodiment, a bond flange 18 is defined as the overlapping mating section where the hull 14 and the deck 16 are joined together. The bond flange 18 also identifies the location of a bond line, which is an imaginary line around the watercraft 10 where the hull 14 and the deck 16 are joined together. Accordingly, the deck 16 generally comprises the upper structural body of the watercraft 10, which is located above and includes the upper bond flange 18.

The hull 14 is designed such that the watercraft 10 planes or rides on a minimum surface area at the aft end of the hull 14 in order to optimize the speed and handling of the watercraft 10 when up on plane. For this purpose, the hull 14 generally has a V-shaped configuration formed by a pair of inclined section that extend outwardly from a keel line of the hull to the hull's side walls at a dead rise angle. The inclined sections also extend longitudinally from the bow toward the transom of the hull 14. The side walls are generally flat and straight near the stem of the lower hull and smoothly blend towards the longitudinal center of the watercraft at the bow. The lines of intersection between the inclined section and the corresponding side wall form the outer chines of the lower hull section.

Toward the transom of the watercraft, the incline sections of the lower hull 14 extend outwardly from a recessed channel or tunnel 19 that extends upward toward the deck 16. The tunnel 19 has a generally parallelepiped shape and opens through the rear of the transom of the watercraft 10, as seen in FIG. 2.

A plurality of internal walls within the hull define a plurality of compartments in which various components of the watercraft are located. In this manner, operating noise from the watercraft can be reduced. In the illustrated embodiment, two bulkheads 20, 22 (i.e., a fore bulkhead 20 and an aft bulkhead 22) divide the inner space within the hull into three compartments: a fore compartment 24; an engine compartment 26; and an aft compartment 28. Each bulkhead 20, 22 includes at least one connecting pipe 30 that permits adjacent compartments to communicate with each other. The bulkheads 22, 24 also include one or more openings 32 through which cables, wires, fuel lines, etc. pass between the compartments. These openings 32 desirably are generally sealed around the cables, wires, lines, etc. passing through the openings 32, as appreciated from FIG. 1, so that the connecting pipes 30 function as the primary air passage between adjacent chambers. (The cables, wires, lines, etc., which pass through the opening 32 in the aft bulkhead 22, have been omitted from FIG. 1 in order to simplify the drawing.)

Figure 3:
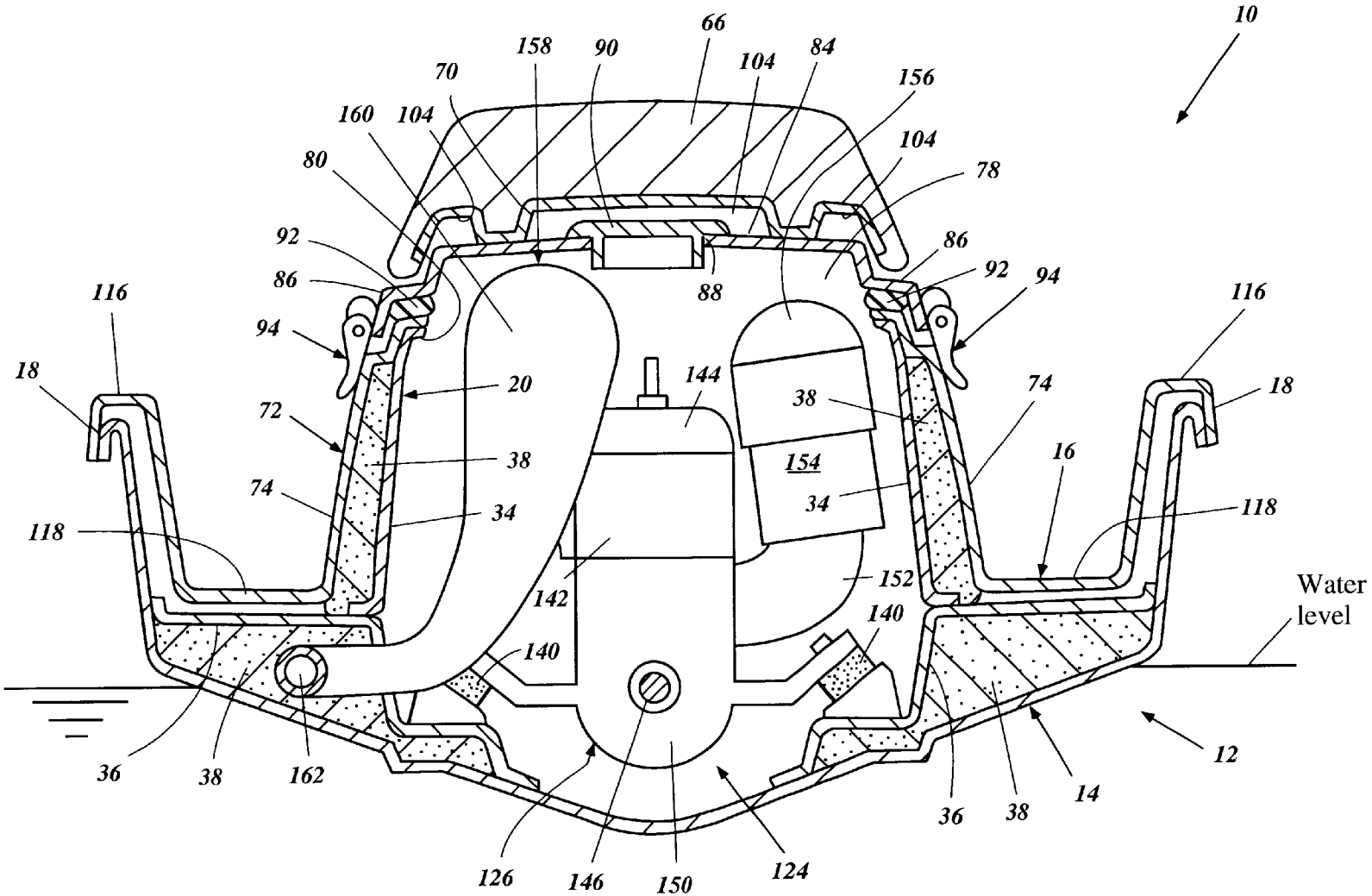
FIG. 3 is a cross-sectional view of the watercraft of FIG. 1 taken along line 3—3.

As appreciated from FIGS. 1 through 3, the fore bulkhead 20 also includes a pair of side walls 34 integrally formed with the bulkhead 20. The side walls 34 extend rearward from the outer lateral sides of the fore bulkhead 20 and lie generally parallel to the longitudinal axis of the watercraft 10. The aft end of the side walls 34 turn outward in the lateral direction and abut a portion of the deck 16. A suitable adhesive (e.g., an epoxy) joins the fore bulkhead 20, and its side walls 34, to an inner side of the deck 16.

Hull liners 36 overlie at least portions of the inclined surfaces of the hull 14. In the illustrated embodiment, as best seen in FIGS. 1 and 2, each hull liner 36 extends from a point in the fore compartment 20 and terminate at the transom of the hull 14 in the longitudinal direction. In the lateral direction, as best seen in FIG. 3, each hull liner 36 is attached to a side wall of the hull 14 and to an inner surface of a corresponding inclined surface of the hull 14. The lower ends fore bulkhead 20 and side walls 34 are also connected to the hull liners, as seen in FIG. 3. The hull liners 36 include several recesses and platforms upon which several components of the watercraft 10 are mounted, as described below.

The hull liners 36, as well as the bulkheads 20, 22 (including the side walls 34) desirably are formed of the same material as the deck 16 and the hull 14. In this manner, these components can be affixed together in a manner well known to those skilled in the art.

A foam material 38 fills the spaces between the hull liners 36 and the hull 14, as well as the spaces between the side walls 34 of the fore bulkhead 20 and the deck 16. In the illustrated embodiment, the foam 38 comprises an expandable urethane foam that can be injected into the spaces. Alternatively, the foam can be pre-molded and placed within the hull 14 before the hull liners 36 and the bulkhead 20 are attached. The foam desirably includes a plurality of air pockets to provide sound insulation as well as floatation. Accordingly, other types of foams can be used as well for this purpose.

With reference to FIG. 1, the deck 16 includes a bow portion 40, a control mast 42 and a rider's area 44, as viewed in the direction from the bow to the stern of the watercraft 10. The bow portion 40 slopes upwardly toward the control mast 42 and includes at least one air duct 46 through which air can enter and/or exit the hull 14. A hatch cover 48 desirably extends above an upper port of the air duct 46 to inhibit an influx of water into the hull 14.

The air duct 46 communicates with a sub-chamber 50 as well as with one of the compartments within the hull 14. In the illustrated embodiment, the air duct 46 communicates with the fore compartment 20 through a lower port and with the sub-chamber 50 through a port 52 formed between the lower port and the upper port. The sub-chamber 50 desirably is sized so as to tune the air system to reduce noise emitted through the air intake and cooling system. That is, the sub-chamber 50 is sized such that pressure pulses within the air duct 46 are dissipated within the sub-chamber 50, which acts as a pressure reducer, similar to a Helmholtz tuning chamber. This system effectively quiets engine noise emitted through the air duct 46.

The sub-chamber 50 also desirably functions as a storage compartment. For this purpose, the sub-chamber 50 is located beneath the hatch cover and has an open upper end.

In the illustrated embodiment, the air duct 46 and the sub-chamber 50 are integrally formed as storage insert 54. The deck 16 includes an opening which receives the storage insert 54, which depends into the fore chamber 20. A seal extends about the upper opening of the sub-chamber 50 and the cover to generally inhibit an influx of water into the sub-chamber 50. The presence of a grating across the port 52 between the duct 46 and the sub-chamber 50, and the position of the port 52 relative to the bottom of the sub-chamber 50, inhibits articles within the sub-chamber 52 from entering the air duct 46.

As seen in FIG. 1, the hatch cover 48 includes a front wall 56 that divides the storage compartment (i.e., sub-chamber 50) from the upper port of the air duct 46. This front wall 56 cooperates with the seal.

As schematically represented in FIG. 1, air A flows through the air duct 46 into the fore compartment 20. (Air A can also flow through the air duct 46 in the opposite direction.) A labyrinth is formed beneath the hatch cover 48 to inhibit an influx of water into the air duct 46. The labyrinth is formed at least in part by the upper end of the air duct 46 extending above the deck surface and by an aft wall 58 that depends from the cover 48 to a point near the level of the upper port of the air duct 46. Water is also inhibited from entering the air duct 46 by the rearward facing opening to the space formed beneath the hatch cover 46.

The control mast 42 extends from the bow portion 40 and supports a handlebar assembly 60. The handlebar assembly 60 controls the steering of the watercraft 10 in a conventional manner. The handlebar assembly 60 also carries a variety of controls of the watercraft 10, such as, for example, a throttle control, a start switch and a lanyard switch. In the illustrated embodiment, a cowling 62, which covers the deck 16, forms a portion of the control mast 42. The deck 16 supports a steering column to which the handlebar assembly 60 is attached, at a point beneath the cowling 62.

A display panel (not shown) desirably is located in front of the control mast 42 on the bow portion 40 and is orientated to be visible by the rider. The display panel desirably displays a number of performance characteristics of the watercraft such as for example, watercraft speed (via a speedometer), engine speed (via a tachometer), fuel level, oil level, engine temperature, battery charge level and the like.

The rider's area 44 lies behind the control mast 42 and includes a seat assembly 64. In the illustrated embodiment, the seat assembly 64 has a longitudinally extending straddle-type shape that may be straddled by an operator and by at least one, two or three passengers.

As best illustrated in FIG. 1, the seat assembly 64 includes a front seat section 66 and a rear seat section 68. Each seat section 66, 68 includes a cushion covered by a water-resilient material and supported by a seat base 70. The seat base 70 desirably is formed of a light-weight material.

Each seat section 66, 68 is attached to a pedestal 72 from on the deck 16. The pedestal 72 includes a pair of side walls 74 and an upper surface 76. As best seen in FIG. 2, the inner side walls 34 of the fore bulkhead 20 lie adjacent to the outer side walls 74 of the pedestal 72 with the foam insulation 38 filing the space between the corresponding inner and outer side walls 34, 74. The upper ends of the inner side walls 34 are joined to an underside of the corresponding pedestal side wall 74, and the lower ends of the inner side walls 34 are joined to an upper side of the corresponding hull liner 36, as described above.

The upper surface 76 defines an access opening 78 that opens into the engine compartment 26 and that is defined by an upper rim 80. The width of the access opening 78 substantially matches the lateral spacing between the upper ends of the pedestal side walls 74. The upper surface 76 also includes a second opening 82 that opens into the aft compartment 28 and is located near an aft end of the pedestal 72.

The pedestal 72 also includes a cover 84 that extends over the access opening 80. The cover 84 includes a side flange projecting downward from a peripheral compression surface 86. The cover 84 also includes one or more access holes 88 sealed by a plug 90. The access holes 88 are located above the engine compartment 26.

A seal 92 extends about the access opening 78 and lies between the cover 84 and the upper rim 80. The seal 92 desirably is affixed either to the rim 80 or to the cover 84 to permit removal and reattachment of the cover 84 without repositioning the seal 92 each time cover 84 is removed.

In the illustrated embodiment, a latch assembly 94 secures the cover 84 to the pedestal walls 74 and compresses the seal 92 between the pedestal rim 80 and the cover compression surface 86. The latch assembly 94 desirably includes a plurality of latches spaced along each side of the cover 84. Other types of mechanisms, however, can be used as well to secure the cover 84 to the pedestal walls 74 and/or to the upper surface 76 of the pedestal 72, and to compress the seal 92 between the cover 84 and the pedestal rim 80 or side walls 74.

As best seen in FIG. 1, a rear end of the front seat section 66 is secured to cover 84 by a seat latch 96. The seat latch 96 desirably is located beneath the rear seat section 68 and cannot be removed without removing the rear seat section 68 first. The front end of the front seat section 66 includes one or more an planar extensions 98 that fit within a receptacle 100. The receptacle 100 is formed on the deck 16 between a portion of the deck 16 and a bracket 102 affixed to the deck 16. The interaction between the extension(s) 98 and the receptacle 100 inhibit lateral and transverse (i.e., vertical) movement of the front seat section front end.

Figure 4:
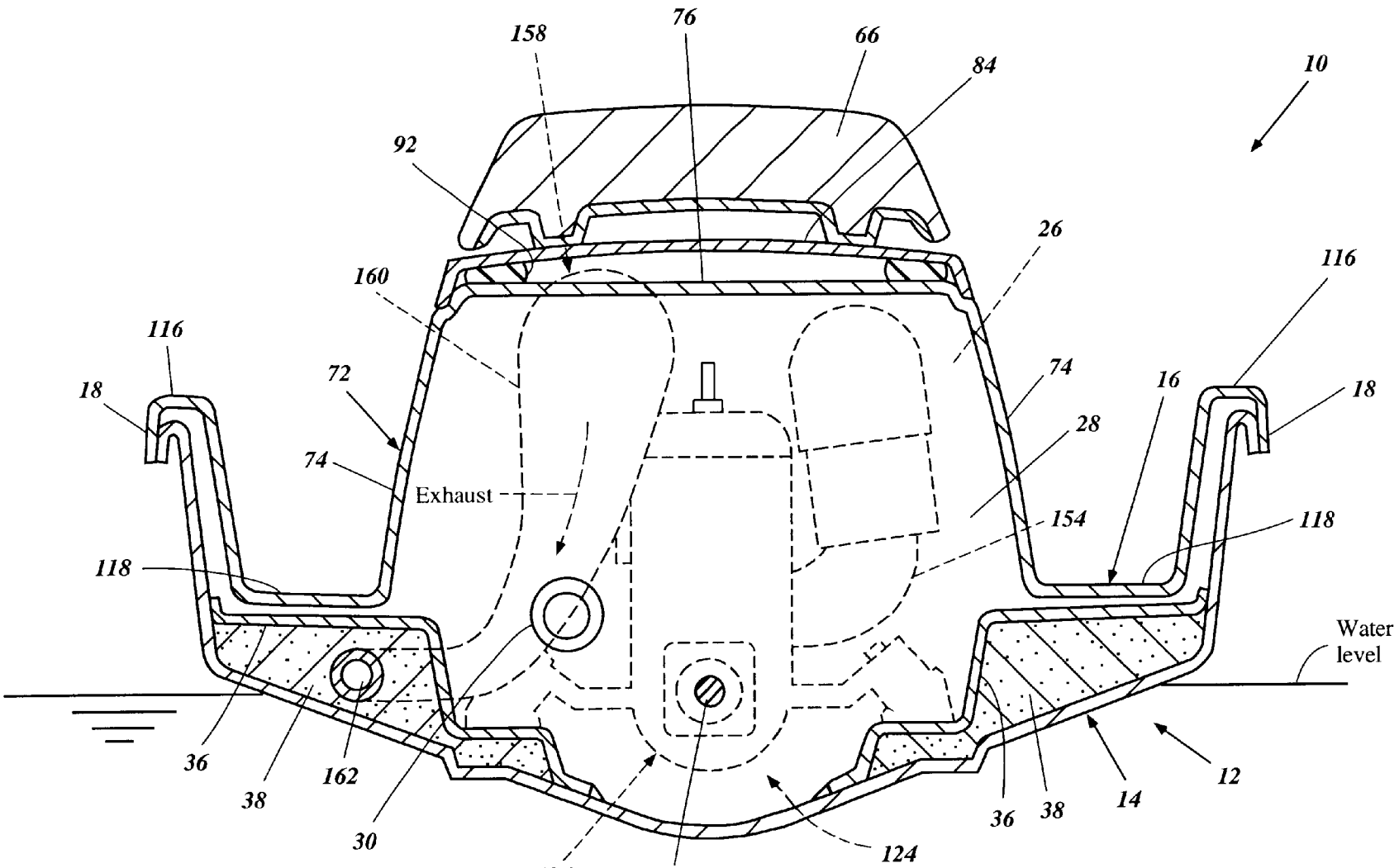
FIG. 4 is a cross-sectional view of the watercraft of FIG. 1 taken along line 4—4.

As appreciated from FIGS. 1, 3 and 4, the seat base 70 of the front seat section 66 includes a plurality of recesses 104 that form air pockets between the seat base 70 and the cover 84. And as seen in FIG. 4, another air pocket is formed between the upper pedestal surface 76 and the cover 84 on the aft side of the access opening 78. These air pockets provide sound insulation on the upper side of the engine and aft compartments 26, 28.

Figure 5:
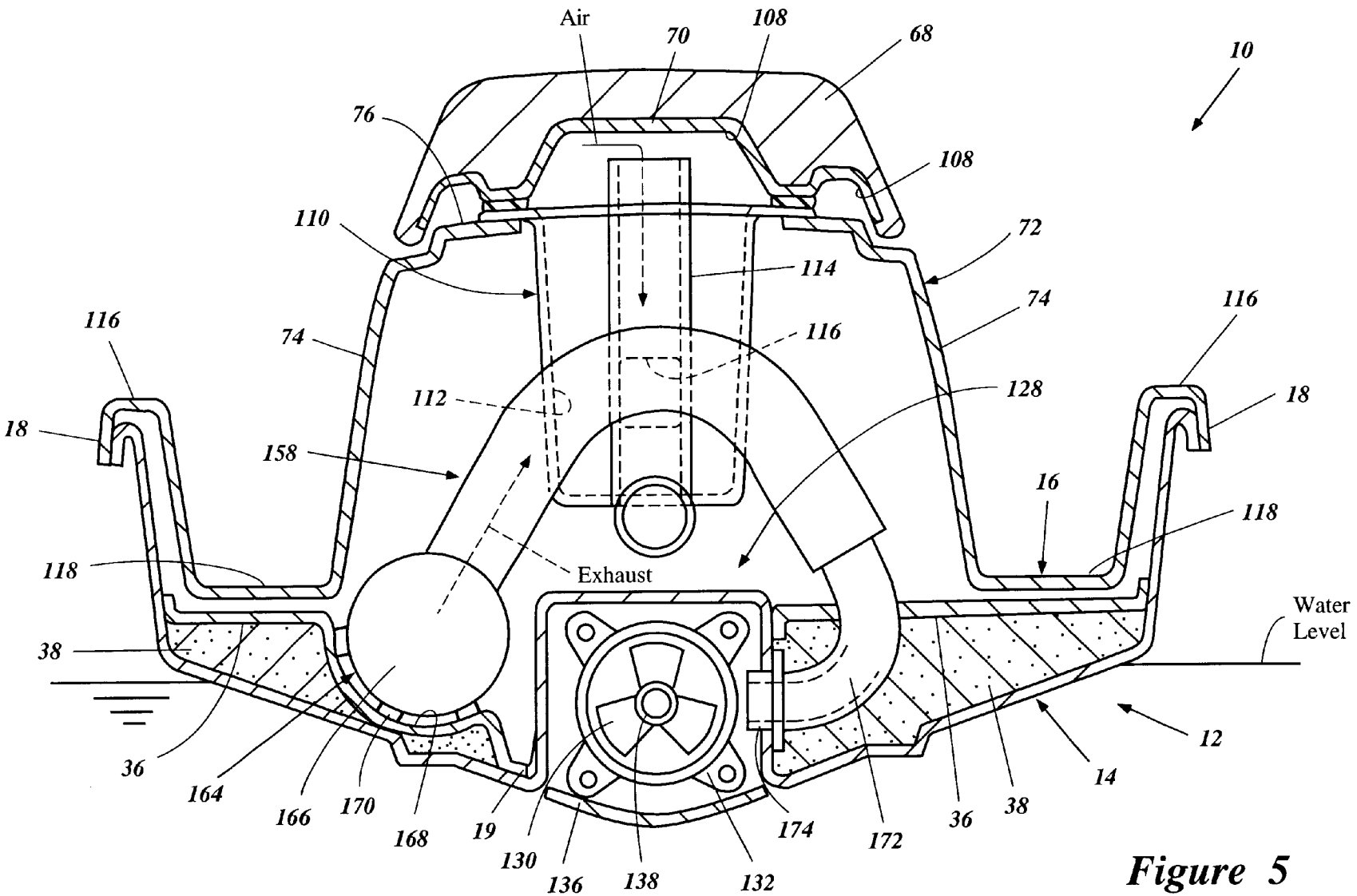
FIG. 5 is a cross-sectional view of the watercraft of FIG. 1 taken along line 5—5.

The rear seat section 68 is attached to the upper surface 76 of the seat pedestal 72 by a latch assembly 106, as seen in FIG. 1, and also includes a plurality of recesses 108, as seen in FIGS. 1 and 5. These recesses 108 form air pockets between the seat base 70 and the pedestal upper surface 76, and provide sound insulation on the upper side of aft compartment 28. The recesses 108 also provide an air flow path beneath the rear seat section 68.

A storage insert 110 is located within the aft opening 82 on the upper surface 76 of the pedestal 72. Like the front storage insert 54, the aft storage insert 110 includes a storage compartment 112 and an air duct 114. The air duct includes an upper port, a lower port, and an opening 116 that communicates with the storage compartment 112. The opening 116 is located between the upper and lower ports and includes grating to prevent object within the storage compartment 112 from passing into the air duct 114.

The upper port of the air duct 114 is located behind the storage compartment 112 and beneath the second seat section 68. The air duct 114 communicates with ambient air through its upper port and through one of the recesses 108 formed on the underside of the rear seat section 68, as described above. Like the front air duct 46, air A can flow in both directions through the air duct 114 in order to supply ambient air to the engine compartment 26, as well as provide a flow of air through the engine compartment 26 and through the aft compartment 28 for cooling purposes. The rearward opening direction of the lower port promotes a circulation of air flow through the aft compartment 28.

The storage compartment desirably is sized so as to tune the air system to reduce noise emitted through the air intake and cooling system. That is, the storage compartment 112 is sized such that pressure pulses within the air duct 114 are dissipated within the storage compartment 112, which acts as a pressure reducer, similar to a Helmholtz tuning chamber. This system thus effectively quiets engine and exhaust system noise emitted through the air duct 114.

The deck 16 of the hull body 12 includes a pair of raised gunnels 116 (FIGS. 2 and 3) positioned on opposite sides of the aft end of the deck 16. The raised gunnels 116 define a pair of foot areas or wells 118 that extend generally longitudinally and parallel to the sides of the pedestal 72. In this position, the operator and any passengers sitting on the seat assembly can place their feet in the foot areas 118 with the raised gunnels 116 shielding the feet and lower legs of the riders. A non-slip (e.g., rubber) mat desirably covers the foot areas 118 to provide increased grip and traction for the operator and the passengers.

With reference to FIG. 1, a fuel tank 120 is located within the fore compartment 24 of the hull 14 beneath the hatch cover 48. Conventional means, such as, for example, straps, secure the fuel tank 120 to the lower hull 16. In addition, as seen in FIG. 1, each hull insert 36 includes a recess 122 that corresponds to the lower shape of the fuel tank 120. A plurality of mounts support the tank 120 within the recesses 122 of the hull inserts 36.

A fuel filler hose (not shown) extends between a fuel cap assembly and the fuel tank 120. In the illustrated embodiment, the filler cap assembly (not shown) is secured to the bow portion of the hull upper deck 16 to the side and in front of the control mast. In this manner, the fuel tank 120 can be filled with fuel F from outside the watercraft body 12 with the fuel F passing through the fuel filler hose into the tank 120.

A propulsion system 124 propels the watercraft 10. The propulsion system 124 comprises an engine 126 that drives a jet pump unit 128. The engine 126 is located in the engine compartment 26, while the jet pump unit 128 is mounted within the tunnel 19 formed on the underside of the hull 14 by a plurality of bolt.

As appreciated in FIG. 2, an intake duct of the jet pump unit 128 defines an inlet opening that opens into a gullet of the intake duct. The intake duct leads to an impeller housing assembly in which the impeller 130 of the jet pump unit 128 operates. An impeller housing assembly also acts as a pressurization chamber and delivers the water flow from the impeller housing to a discharge nozzle 132.

A steering nozzle 134 is supported at the downstream end of the discharge nozzle 132 by a pair of vertically extending pivot pins. In an exemplary embodiment, the steering nozzle has an integral lever on one side that is coupled to the handlebar assembly 60 through, for example, a bowden-wire actuator, as known in the art. In this manner, the operator of the watercraft 10 can move the steering nozzle 134 to effect directional changes of the watercraft 10.

As seen in FIG. 5, a ride plate 136 covers a portion of the tunnel 19 behind the inlet opening to enclose the jet pump unit 128 with the tunnel 19. In this manner, the lower opening of the tunnel 19 is closed to provide a planing surface for the watercraft 10.

An impeller shaft 138 (FIG. 2) supports the impeller 130 within the impeller housing of the jet pump unit 128. The aft end of the impeller shaft 138 is suitable supported and journalled within the compression chamber of the jet pump unit 128 in a known manner. The impeller shaft 138 extends in the forward direction through a front wall of the tunnel 19 and through the aft bulkhead 22.

The internal combustion engine 126 of the watercraft 10 powers the impeller shaft 138 to drive the impeller 130 of the jet pump unit 128. As seen in FIGS. 1 through 3, the engine 126 is positioned within the engine compartment 26 and is mounted behind the control mast 42, beneath the seat assembly 64. Vibration-absorbing engine mounts 140 (FIG. 3) secure the engine to bosses on the hull inserts 36. The engine 126 is mounted in approximately a central position in the watercraft 10. This construction, in which the engine 126 is mounted onto the foam-insulated hull inserts 36, thus further decouples the hull 14 from engine vibration and noise.

In the illustrated embodiment, the engine 126 includes three in-line cylinders and operates on a two-stroke, crankcase compression principle. The engine is positioned such that the row of cylinders lies parallel to a longitudinal axis of the watercraft 10, running from bow to stern. The axis of each cylinder is generally parallel relative to a vertical central plane of the watercraft 10, in which the longitudinal axis lies. In this position, the engine 126 lies completely beneath the access opening 78 to facilitate removal of the engine 126 from the watercraft 10. That is, the lateral size of the access opening 78 is wider than the lateral width of the engine 126, as seen in FIG. 3. This engine type, however, is merely exemplary. Those skilled in the art will readily appreciate that the present seat design and engine component layout can be used with a variety of engine types having other number of cylinders, having other cylinder arrangements (e.g., inclined) and operating on other combustion principles (e.g., four-stroke principle).

As best seen in FIG. 3, a cylinder block 142 and a cylinder head assembly 144 desirably form the cylinders of the engine 126 A piston (not shown) reciprocates within each cylinder of the engine 126 and together the pistons drive an output shaft 146, such as a crankshaft, in a known manner. A connecting rod (not shown) links the corresponding piston to the crankshaft 146. The corresponding cylinder bore, piston and cylinder head of each cylinder forms a variable-volume chamber, which at a minimum volume defines a combustion chamber. A coupling 148 couples the crankshaft 146 to the impeller shaft 138, as best seen in FIG. 2.

A plurality of spark plugs are mounted in the cylinder head 144 with each spark plug corresponding to one of the cylinders. As appreciated from FIG. 3, the accessing holes 88 in the cover 84 preferably correspond to the position of the spark plugs to permit replacement of the spark plugs without removal of the cover 84.

The crankshaft 146 desirably is journaled with a crankcase 150, which in the illustrated embodiment is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber.

Each crankcase chamber also communicates with an intake pipe 152 of an induction system of the engine through a check valve (e.g., a reed-type valve). In the illustrated embodiment, the intake pipes 152 are separate from the crankcase and from each other; however, the engine 126 can use an intake manifold equally well, or can integrally form the intake pipes with the crankcase member.

A plurality of charge formers 154 (e.g., a carburetor) of the induction system communicate with inlet ends of the corresponding intake pipes 152. The charge formers 154 receive fuel from the fuel tank 120 and produces the fuel charge which is delivered to the cylinders in a known manner. An air intake silencer or plenum chamber 156 of the induction system is connected to an air inlet end of a throttle passage of each charge former 154.

An exhaust system 158 discharges exhaust byproducts from the engine 126 to the atmosphere and/or to the body of water in which the watercraft 10 is operated. As best seen in FIGS. 1, 2 and 4, the exhaust system includes the exhaust manifold that is affixed to the side of the cylinder block 142 and which receives exhaust gases from the combustion chambers through exhaust ports in a well-known manner. For this purpose, the exhaust manifold desirably includes a number of runners equal in number to the number of cylinders. Each runner communicates with the exhaust port (s) of the respective cylinder. The runners of the exhaust manifold thence merge together at a merge point to form a common exhaust path that terminates at an outlet end of the manifold.

An outlet end of the exhaust manifold communicates with an exhaust expansion chamber 160. The outlet end of the manifold turns upward to mate with a down-turned inlet end of the expansion chamber 160.

The expansion chamber 160 turns downward and communicates with a connection pipe 162. As best understood from FIGS. 1, 3 and 4, the connection pipe 162 extends outward in a lateral direction and then turns aft. In doing so, the connection pipe 162 extends through the near hull insert 36 and lies within the space formed between the hull 14 and the hull insert 36. Insulation material 38 surrounds at least a portion of the connection pipe 162 to silence exhaust noises from the connection pipe 162. Such insulation 38 is important because of the close spacing of the connection pipe 162 to the wall of the hull 14. The insulation 38 also enhances heat resistance at this location of the watercraft hull 14.

The downstream end of the connection pipe 162 communicates with a water trap 164. The water trap 164 includes a generally cylindrical body 166 that resides within a recess 168 formed within the hull inserts 36. As best seen in FIG. 5, the hull insert 36 includes a generally semi-cylindrical indentation 168 that forms a cradle. An elastic insulation layer 170 lines the surface of the cradle recess 168 with the water trap body set on top the insulation layer 170. Desirably, this layer 170 generally thermally and vibrationally decouples the water trap 164 from the hull 14. Alternatively, standoff mounts can support the water trap body 166 relative to the cradle recess 168. One or more elastic straps, which are secured to the lower hull portion 14 by bolts 118, hold the water trap body 166 within the recess cradle 168.

The water trap device 164 has a sufficient volume to retain water and to preclude the back flow of water to the expansion chamber 160 and the engine 126. Internal baffles within the water trap device 164 help control water flow through the exhaust system 158.

An exhaust discharge pipe 172 extends from an outlet section of the water trap device 164 and wraps over the top of the tunnel 19 to a discharge end 174. As seen in FIG. 5, an insulation cover surrounds at least a portion of the discharge pipe 172. The discharge end 174 desirably opens into the tunnel 19 or through the transom of the watercraft 10 at an area that is close to or actually below the water level with the watercraft 10 floating at rest on the body of water.

As will be appreciated by one skilled in the art, the various sound insulating techniques described above can be used either alone or together. For instance, seat construction need not be used with in insulation material; however, enhanced noise dampening can be obtained by insulating the sides of the pedestal, the lower hull walls and the lower side of the seat in the manners described above. Thus, the air pockets, foam insulation between the inner and outer walls of the pedestal, and the foam insulation between the hull inserts and the hull surfaces all contribute to improving the sound insulation of the engine compartment and the aft compartment. Additional sound attenuation is achieved by the air supply and cooling system including sub-resonant chambers and by insulating at least a portion of the exhaust system.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A watercraft comprising a hull having a lower hull portion and an upper deck portion, an internal combustion engine located within the hull and having an output shaft, and a propulsion device carried by the hull and driven by the engine output shaft to propel the watercraft, the upper deck portion including a central elongated pedestal having a first and second sections, the second section defining lateral walls of an engine compartment in which the internal combustion engine is disposed, the first section defining an upper wall of the engine compartment, the first section being removably attached to the second section with a releaseable connector for reinforcing the lateral walls and being arranged to form at least a portion of an upper surface of the pedestal, and a seat with a base, the seat base being removably attached to the first section of the pedestal.

2. A watercraft as in claim 1, wherein the first section of the pedestal covers an access opening located above the engine.

3. A watercraft as in claim 2, wherein the access opening is wider than the engine.

4. A watercraft as in claim 1, wherein the first section of the pedestal defines at least one access hole, and a plug removably closes the hole.

5. A watercraft as in claim 1, wherein the base and the first section together define at least one air pocket.

6. A watercraft comprising a hull having a lower hull portion and an upper deck portion, an internal combustion engine located within the hull and having an output shaft, a propulsion device carried by the hull and driven by the engine output shaft to propel the watercraft, at least one air duct with a first port arranged to communicate with ambient air from outside the hull and a second port opening into the hull, and a sub-resonator chamber communicating with the air duct at a point between the first and second ports, wherein the sub-resonator chamber is defined, at least in part, by a storage container.

7. A watercraft as in claim 6, wherein the sub-resonator chamber is located beneath a movable member of the watercraft.

8. A watercraft as in claim 7, wherein the movable member is a hatch cover attached to the upper deck portion.

9. A watercraft as in claim 7, wherein the movable member is a seat cushion attached to the upper deck portion.

10. A watercraft as in claim 6 additionally comprising a second air duct communicating with a second sub-resonator chamber.

11. A watercraft as in claim 6, wherein the sub-resonator chamber provides sound attenuation.

12. A watercraft comprising a hull having a lower hull portion and an upper deck portion, an internal combustion engine located within the hull and having an output shaft, a propulsion device carried by the hull and driven by the engine output shaft to propel the watercraft, at least one air duct with a first port arranged to communicate with ambient air from outside the hull and a second port opening into the hull, and a sub-resonator chamber communicating with the air duct at a point between the first and second ports, wherein at least one side of the sub-resonator chamber is removable from an upper side of the hull.

13. A watercraft comprising a hull having a lower hull portion and an upper deck portion, an engine compartment formed within the hull and defined between a fore bulkhead and an aft bulkhead, a fore compartment formed forward from the fore bulkhead, an aft compartment formed rearward from the aft bulkhead, each of the fore and aft compartments communicating with the engine compartment through at least one tube, an internal combustion engine located within the engine compartment and having an output shaft, and a propulsion device carried by the hull and driven by the engine output shaft to propel the watercraft.

14. A watercraft as in claim 13, additionally comprising at least one air duct communicating with the hull and with a sub-resonator chamber located within the hull.

15. A watercraft as in claim 14, wherein the air duct is located outside the engine compartment.

16. A watercraft as in claim 13, additionally comprising at least one air duct having a first end exposed to ambient air and a second end terminating in one of the fore compartment and the aft compartment.

17. A watercraft comprising a hull having a lower hull portion and an upper deck portion, an engine compartment formed within the hull and defined between a fore bulkhead and an aft bulkhead, a fore air duct opening into the hull forward of the fore bulkhead and an aft air duct opening into the hull rearward of the aft bulkhead, an internal combustion engine located within the engine compartment and having an output shaft, and a propulsion device carried by the hull and driven by the engine output shaft to propel the watercraft.

18. A watercraft as in claim 17, wherein each bulkhead includes a communication pipe that places each air duct in communication with the engine compartment.

19. A watercraft comprising a hull having a lower hull portion and an upper deck portion, an internal combustion engine located within the hull and having an output shaft, and a propulsion device carried by the hull and driven by the engine output shaft to propel the watercraft, the upper deck portion including a central elongated pedestal having an upper portion supporting a seat and defining an engine compartment for the engine having a lower wall, a pair of outer side walls, and a pair of inner side walls, each inner side wall spaced apart from a corresponding outer side wall so as to define a gap therebetween, the inner side wall, outer side wall, and the gap defining at least a part of the upper portion of the central elongated pedestal, at least a portion of the engine being located between the inner side walls, at least a portion of the lower wall being disposed below a waterline of the watercraft and not including inner and outer walls that are spaced apart, wherein the upper deck portion additionally includes an acoustic insulating material positioned between each corresponding pair of inner and outer side walls.

20. A watercraft as in claim 19, wherein the portion of the lower wall of the engine compartment which is below the waterline comprises a single-walled construction.

21. A watercraft comprising a hull having a lower hull portion and an upper deck portion, an internal combustion engine located within the hull and having an output shaft, and a propulsion device carried by the hull and driven by the engine output shaft to propel the watercraft, the upper deck portion including a central elongated pedestal defining an engine compartment for the engine having a lower wall, a pair of outer side walls, and a pair of inner side walls, each inner side wall spaced apart from a corresponding outer side wall, at least a portion of the engine being located between the inner side walls, at least a portion of the lower wall being disposed below a waterline of the watercraft and not including inner and outer walls that are spaced apart, a seat with a base, the seat base being removably attached to the pedestal, and the seat base and the pedestal together defining at least one air pocket between the base and the pedestal.

22. A watercraft comprising a hull having a lower hull portion and an upper deck portion, an internal combustion engine located within the hull and having at least one exhaust port and an output shaft, a propulsion device carried by the hull and driven by the engine output shaft to propel the watercraft, and an exhaust system communicating with the at least one exhaust port and extending to a discharge end, the lower hull portion including a hull insert overlying a portion of the hull with a layer of acoustic insulation material filling the space between the hull insert and the lower hull portion, at least a portion of the exhaust system positioned between the hull insert and the lower hull portion and surrounded by the acoustic insulation material.

23. A watercraft as in claim 22, wherein the engine is mounted to the hull inserts.

24. A watercraft comprising a hull having a lower hull portion and an upper deck portion, an internal combustion engine located within the hull and having at least one exhaust port and an output shaft, a propulsion device carried by the hull and driven by the engine output shaft to propel the watercraft, and an exhaust system communicating with the at least one exhaust port and extending to a discharge end, the lower hull portion including a hull insert overlying a portion of the hull with a layer of insulation material filling the space between the hull insert and the lower hull portion, at least a portion of the exhaust system positioned between the hull insert and the lower hull portion and surrounded by the insulation material, wherein the hull insert includes a recessed cradle shaped to receive at least a portion of the exhaust system.

25. A watercraft as in claim 24, wherein the exhaust system includes a water trap, and the recessed cradle is shaped to receive at least a portion of the water trap.

* * * * *